United States Patent [19]

Shemyakina et al.

[11] Patent Number: 4,497,696

[45] Date of Patent: Feb. 5, 1985

[54] GOLD-PLATING ELECTROLYTE AND PROCESS FOR PREPARING SAME

[76] Inventors: Elena V. Shemyakina, ulitsa 800 let Moskvy, 3, korpus 2, kv. 8; Nina M. Dyatlova, Samotechny pereulok, 4, korpus 1, kv. 4; Alexandr I. Formenov, 7-ya Parkovaya ulitsa, 30, kv. 164; Alexandr V. Belikin, ulitsa Vilisa Latsisa, 4, kv. 208; Alexandr Y. Fridman, ulitsa 800 let Moskvy, 3, korpus 2, kv. 8; Nina I. Sinko, Zhigulevskaya ulitsa, 32, kv. 47; Iosif G. Erusalimchik, Sirenevy bulvar, 19, kv. 21, all of Moscow; Galina I. Efimova, ulitsa Gagarina 4, kv. 67; Julian P. Zavalsky, ulitsa Pionerskaya, 12, kv. 9, both of poselok Tomilino, Moskovskaya oblast, all, U.S.S.R.

[21] Appl. No.: 340,351

[22] Filed: Jan. 18, 1982

[51] Int. Cl.[3] ..... C01G 7/00; C25D 3/48

[52] U.S. Cl. ..... 204/46 G; 204/44.3; 260/430

[58] Field of Search ..... 204/46 G, 43 G; 260/430

[56] References Cited

U.S. PATENT DOCUMENTS

| | | | |
|---|---|---|---|
| 3,057,789 | 10/1962 | Smith | 204/46 G |
| 3,787,463 | 1/1974 | Zuntini et al. | 260/430 |
| 4,192,723 | 3/1980 | Laude et al. | 204/46 G X |
| 4,212,708 | 7/1980 | Smagunova et al. | 204/43 G X |

*Primary Examiner*—Brian E. Hearn
*Assistant Examiner*—Nathan Thane
*Attorney, Agent, or Firm*—Robert E. Burns; Emmanuel J. Lobato; Bruce L. Adams

[57] ABSTRACT

A gold-plating electrolyte which has the following composition, g/l:

| | |
|---|---|
| hexapotassium-m-ethylenediamine-tetraacetobis-(aurous sulphite) | 10.5–210 |
| alkali metal salts of ethylenediamine-tetraacetic acid | 17.8–140 |
| distilled water | the balance. |

The electrolyte can also incorporate additivies—ethylenediaminetetraacetocopper (II)-bis(2-aminoethylammonium) or ethylenediamine tetraacetocadmium-bis-(2-aminoethylammonium) in an amount of from 0.01 to 15 g/l.

The process for preparing the gold-plating electrolyte comprises interaction of the reagents—chloroauric acid, salts of alkali metals of ethylenediamineteteraacetic acid, an alkali metal sulphite, caustic potash and ammonium chloride; this process is effected in one stage in distilled water at a temperature of 80°–90° C., the components being present in the following proportions, g/l:

| | |
|---|---|
| chloroauric acid | 12.6–250 |
| alkali metal salt of ethylenediamine-tetraacetic acid | 39–1,000 |
| alkali metal sulphite | 6–190 |
| caustic potash | 32–800 |
| ammonium chloride | 6.6–132; |

As a result of this interaction, a gold-plating electrolyte is obtained along with the precipitate of chlorides and sulphates of alkali metals, which precipitate is separated from the electrolyte by filtration. The electrolyte according to the present invention has a high content of hexapotassium-m-ethylenediaminetetraacetatobis(aurous sulphite) and contains no impurities affecting the progress of the gold-plating process. The process for the preparation of the electrolyte is simple and makes it possible to substantially fully eliminate irrevocable mechanical losses of gold.

8 Claims, No Drawings

GOLD-PLATING ELECTROLYTE AND PROCESS FOR PREPARING SAME

FIELD OF THE INVENTION

The present invention relates to the art of producing metal coatings by electroplating and, more specifically, to a gold-plating electrolyte and a process for preparing same.

This invention can be useful in electronics, watch manufacture, jewelry, radio-engineering.

BACKGROUND OF THE INVENTION

An electrolyte is known in the art for gold-plating which has the following composition, g/l:

| | |
|---|---|
| hexapotassium-m-ethylenediaminetetraacetato-bis-(aurous sulphite) $K_6$ [$Au_2(SO_2)_2$Edta] | 10.5–123 |
| alkali metal salts of ethylenediamine-tetraacetic acid $Me_4$Edta | 17.8–140 |
| potassium sulphate $K_2SO_4$ | 12.6–110 |
| bisubstituted potassium phosphate $K_2HPO_4$ | 4.7–40 |
| distilled water | the balance. |

(Cf. USSR Inventor's Certificate No. 666920, Cl. C 25 D 3/48, 1976; U.S. Pat. No. 4,212,708; Cl. 204–43G).

Also known is a process for the preparation of the above specified electrolyte comprising precipitation, from an aqueous solution of chloroauric acid by means of disubstituted ammonium phosphate, of a sparingly soluble gold compound—bis-(dihydrophosphatomonohydrophosphato)-aurate of ammonium; the residue is washed to remove chloride ions and then dissolved by addition to an aqueous solution of disodium salt of ethylenediaminetetraacetic acid, caustic potash and potassium sulphite (see the opt.cit. reference).

This process is a multi-staged one which results in irrevocable mechanical loss of gold. Furthermore this process gives an electrolyte containing bisubstituted potassium phosphate and potassium sulphate. Upon correction of the electrolyte bath by the electrolyte of the above-specified composition, these substances are accumulated in the bath, thus affecting the course of the gold-plating process.

This process does enable the production of an electrolyte with a content of hexapotassium-m-ethylenediaminetetraacetatobis-(aurous sulphite /I/) above 123 g/l. The impossibility of increasing, in the electrolyte, the content of hexapotassium-m-ethylenediaminetetraacetatobis-(aurous sulphite), as well as the presence of contaminants of bisubstituted potassium phosphate and potassium sulphate limits the scope of application of the above-mentioned electrolyte.

SUMMARY OF THE INVENTION

It is an object of the present invention to provide a gold-plating electrolyte containing no impurities of bisubstituted potassium phosphate and potassium sulphate with a higher content of hexapotassium-m-ethylenediaminetetraacetatobis-(auric sulphite), as well as to provide a simple process for the preparation of the electrolyte for gold-plating which would make it possible to fully avoid irrevocable losses of gold.

These and other object are accomplished by a gold-plating electrolyte having the following composition, g/l:

| | |
|---|---|
| hexapotassium-m-ethylenediaminetetraacetatobis-(aurous sulphite) | 10.5–210 |
| alkali metal salts of ethylenediamine-tetraacetic acid | 17.8–140 |
| distilled water | the balance. |

At a content, in the electrolyte, of hexapotassium-m-ethylenediaminetetraacetatobis-(aurous sulphite) below 10.5 g/l the rate of electroplating is insufficient, while at a content thereof above 210 g/l the quality of the resulting coating is impaired.

The content, in the electrolyte, of an alkali metal salt of ethylenediaminetetraacetic acid has relationship with the content of hexapotassium-m-ethylenediaminetetraacetato-bis-(aurous sulphite) in the electrolyte.

The electrolyte according to the present invention contains no impurities in the form of phosphates and sulphates of alkali metals; it contains high concentrations of hexapotassium-m-ethylenediaminetetraacetatobis-(aurous sulphite) which provides broad opportunities for its use.

Accumulation of an alkali metal salt of ethylenediaminetetraacetic acid in the electrolytic bath does not affect the gold-plating process.

In order to increase the current yield and the coating hardness, it is advisable to use a gold-plating electrolyte also containing ethylenediaminetetraacetatocopper-/II/-bis-(2-aminoethylammonium) or ethylenediaminetetraacetatocadmium-(2-aminoethylammonium) in an amount of from 0.01 to 15 g/l.

These additives in an amount below 0.01 g/l do not provide any effect on the coating quality, while in an amount of above 15 g/l they cause an excessive hardness of the coating increasing its inner stresses which is intolerable.

The electrolyte according to the present invention is prepared by the process which, according to the present invention, comprises interaction of the reagents—chloroauric acid, an alkali metal salt of ethylenediaminetetraacetic acid, an alkali metal sulphite, caustic potash and ammonium chloride in distilled water in a single stage at a temperature of from 80° to 90° C. and with the following proportions of the reagents, g/l:

| | |
|---|---|
| chloroauric acid | 12.6–250 |
| alkali metal salt of ethylenediamine-tetraacetic acid | 39–1,000 |
| alkali metal sulphite | 6–190 |
| caustic potash | 32–800 |
| ammonium chloride | 6.6–132; |

as a result of this interaction a gold-plating electrolyte is obtained along with a precipitate of chlorides and sulphates of alkali metals which precipitate is separated from the electrolyte by filtration.

The process according to the present invention is simple. It enables a substantially full elimination of irrevocable mechanical losses of gold. The use of the above-mentioned compounds in the process of this invention within the above-specified range is explained by the composition of the electrolyte to be obtained.

In order to increase the current yield and hardness of the coating, it is advisable to add, to the resulting electrolyte after the filtration, ethylenediaminetetraacetatocopper-/II/-bis-(2-aminoethylammonium) or ethylenediaminetetraacetatocadmium-bis-(2-aminoethylammonium) in an amount of from 0.01 to 15 g/l.

DETAILED DESCRIPTION OF THE INVENTION

The gold-plating electrolyte according to the present invention is prepared in the following manner.

Chloroauric acid, an alkali metal sulphite, caustic potash and ammonium chloride are reacted in distilled water. The process is conducted in a single stage at a temperature of 80°–90° C. The resulting solution is cooled, kept to ensure precipitation of chlorides and sulphates of alkali metals which are then filtered-off.

To increase the current yield and hardness of the coating, it is advisable to introduce into the thus-prepared electrolyte, as it has been already mentioned hereinabove, ethylenediaminetetraacetatocopper/II/-bis-(2-aminoethylammonium) or ethylenediaminetetraacetatocadmium-bis-(2-aminoethylammonium) in an amount of from 0.01 to 15 g/l. These additives comprise water-soluble powders.

Ethylenediaminetetraacetatocopper/II/-bis-(2-aminoethylammonium) is prepared by reacting ethylenediaminetetraacetic acid with copper carbonate and ethylenediamine, followed by isolation from dimethylformamide.

Ethylenediaminetetraacetatocadmium-bis-(2-aminoethylammonium) is prepared by reacting ethylenediaminetetraacetic acid with cadmium carbonate and ethylenediamine, followed by isolation from dimethylformamide.

The gold-plating electrolyte according to the present invention has a throwing power of up to 100%, current yield of 90–100%. The storage period of the electrolyte at the temperature of 25° C. is more than two years, the beginning of decomposition of the electrolyte is at $D_k=15$ A/dm$^2$. This electrolyte ensures the production of high-quality coatings with a very fine dispersity and Vickers hardness of from 70 to 200 kg/mm$^2$, poreless at the thickness of 3 μm and more.

The gold-plating electrolyte according to the present invention, as compared to that of the prior art, has an increased content of hexapotassium-m-ethylenediaminetetraacetatobis-(aurous sulphite) and the process for producing it makes it possible to simplify the technology and substantially fully avoid irrevocable mechanical losses of gold.

For a better understanding of the present invention, some specific examples illustrating particular compositions of the gold-plating electrolyte according to the present invention and the process for producing same are given hereinbelow.

EXAMPLE 1

Chloroauric acid (250 g) is reacted with disodium salt of ethylenediaminetetraacetic acid (785 g), potassium sulphite (190 g), caustic potash (640 g) and ammonium chloride (132 g) in 950 ml of distilled water in a single stage at the temperature of 90° C.

On completion of the reaction the solution is cooled and kept until a precipitate is formed comprising chlorides and sulphates of alkali metals (sodium and potassium). The solution is then filtered to remove the precipitate of these salts and distilled water is added to the volume of 1 liter. As a result, a gold-plating electrolyte is obtained which has the following composition, g/l:

| | |
|---|---|
| hexapotassium-m-ethylenediaminetetraacetatobis-(aurous sulphite) | 210 |
| salts of sodium and potassium of ethylenediaminetetraacetic acid | 52 |
| distilled water | the balance. |

The electrodeposition is carried out at the temperature of 30° C. with stainless steel or graphite anodes and with the use of a standard equipment. $D_k=0.6$ A/dm$^2$, pH=7.5–8.0, stirring.

The current yield is 98%. Vickers hardness of the coating is 75–80 kg/mm$^2$. The coating is dark-yellow, matted.

EXAMPLE 2

Chloroauric acid (12.6 g) is reacted with disodium salt of ethylenediaminetetraacetic acid (39 g), potassium sulphite (9.5 g), caustic potash (32 g) and ammonium chloride (6.6 g) in 125 ml of distilled water at a temperature of from 80° to 85° C.

On completion of the reaction the solution is cooled and kept to ensure precipitation of chlorides and sulphates of alkali metals (sodium and potassium). Then the solution is filtered to remove the precipitate and distilled water is added to the filtered solution to the volume of 1 liter. As a result, a gold-plating electrolyte with the following composition is obtained, g/l:

| | |
|---|---|
| hexapotassium-m-ethylenediaminetetraacetatobis-(aurous sulphite) | 10.5 |
| sodium and potassium salts of ethylenediaminetetraacetic acid | 17.8 |
| distilled water | the balance. |

The electrodeposition is carried out at the temperature of 40° C. with platinum or platinized-titanium anodes. $D_k=0.3$ A/dm$^2$ pH=8.0–8.5, stirring.

The current yield is 98%. Vickers hardness is 90 kg/cm$^2$. The coating is yellow and glossy.

EXAMPLE 3

Chloroauric acid (32.5 g) is reacted with disodium salt of ethylenediaminetetraacetic acid (256.9 g), potassium sulphite (22.7 g), caustic potash (216 g) and ammonium chloride (17.2 g) in 240 ml of distilled water at a temperature of 80°–85° C.

On completion of the reaction the solution is cooled and kept to ensure precipitation of chlorides and sulphates of alkali metals (sodium and potassium). Then the solution is filtered to remove the precipitate and distilled water is added to the volume of 1 liter. As a result, a gold-plating electrolyte is obtained which has the following composition, g/l:

| | |
|---|---|
| hexapotassium-m-ethylenediaminetetraacetatobis-(aurous sulphite) | 27 |
| sodium and potassium salts of ethylenediaminetetraacetic acid | 19 |
| distilled water | the balance. |

The electrodeposition is carried out at the temperature of 60° C. with platinum, graphite or stainless steel anodes. $D_k=0.3$ A/dm$^2$, pH=8.0–9.0, stirring.

The current yield is 97%. Vickers hardness of the coating is 92 kg/mm$^2$. The coating is glossy and light-yellow.

EXAMPLE 4

Chloroauric acid (105 g) is reacted with disodium salt of ethylenediaminetetraacetic acid (1,000 g), potassium sulphite (95 g), caustic potash (800 g) and ammonium chloride (66 g) in 750 ml of distilled water at a temperature of from 80° to 85° C.

On completion of the reaction the solution is cooled and kept to ensure precipitation of chlorides and sulphates of alkali metals (sodium and potassium). Then the solution is filtered to remove the precipitate and distilled water is added to the volume of 1 liter. As a result, a gold-plating electrolyte is obtained which has the following composition, g/l:

| | |
|---|---|
| hexapotassium-m-ethylenediaminetetraacetatobis-(aurous sulphite) | 105 |
| sodium and potassium salts of ethylenediaminetetraacetic acid | 140 |
| distilled water | the balance. |

The electrodeposition is conducted at the temperature of 80° C. with platinum or platinized-titanium anodes. $D_k=0.7$ A/dm$^2$, pH=9.0, stirring.

The current yield is 97%. Vickers hardness of the coating is 90 kg/mm$^2$. The coating is matted, yellow.

EXAMPLE 5

Chloroauric acid (32.5 g) is reacted with dipotassium salt of ethylenediaminetetraacetic acid (437 g), potassium sulphite (22.7 g), caustic potash (216 g) and ammonium chloride (17.2 g) in 240 ml of distilled water at the temperature of 80°-85° C.

On completion of the reaction the solution is cooled and maintained until precipitation of potassium chlorides and sulphates occurs. Then the solution is filtered to remove the precipitate and distilled water is added thereto to the volume of 1 liter. As a result, a gold-plating electrolyte is obtained which has the following composition, g/l:

| | |
|---|---|
| hexapotassium-m-ethylenediaminetetraacetatobis-(aurous sulphite) | 27 |
| potassium salt of ethylenediaminetetraacetic acid | 32 |
| distilled water | the balance. |

The electrodeposition is carried out at the temperature of 70° C. with platinum, graphite or stainless-steel anodes. $D_k=0.4$ A/dm$^2$, pH=8.0-9.0, stirring.

The current yield is 97%. The hardness of the coating (Vickers) is 93 kg/mm$^2$. The coating is glossy, light-yellow.

EXAMPLE 6

Chloroauric acid (12.6 g) is reacted with disodium salt of ethylenediaminetetraacetic acid (39 g), sodium sulphite (6 g) caustic potash (32 g) and ammonium chloride (6.6 g) in 125 ml of distilled water at a temperature of 80°-85° C.

On completion of the reaction the solution is cooled and maintained to ensure precipitation of chlorides and sulphates of alkali metals (sodium and potassium). Then the solution is filtered to remove the precipitate and distilled water is added to the volume of 1 liter. As a result, a gold-plating electrolyte is obtained which has the following composition, g/l:

| | |
|---|---|
| hexapotassium-m-ethylenediaminetetraacetatobis-(aurous sulphite) | 10.5 |
| sodium and potassium salts of ethylenediaminetetraacetic acid | 17.8 |
| distilled water | the balance. |

The electrodeposition is carried out at the temperature of 45° C. with platinum or platinized-titanium anodes. $D_k=0.3$ A/dm$^2$, pH=8.0, stirring.

The current yield is 98%. Vickers hardness of the coating is 90 kg/mm$^2$. The coating is glossy, yellow.

EXAMPLE 7

To 1 liter of the electrolyte prepared in Example 2 there is added 0.01 g of ethylenediaminetetraacetatocadmiumbis-(2-aminoethylammonium). As a result, a gold-plating electrolyte is obtained with the following composition, g/l:

| | |
|---|---|
| hexapotassium-m-ethylenediaminetetraacetatobis-(aurous sulphite) | 10.5 |
| sodium and potassium salts of ethylenediaminetetraacetic acid | 17.8 |
| ethylenediaminetetraacetatocadmiumbis-(2-aminoethylammonium) | 0.01 |
| distilled water | the balance. |

The electrodeposition is conducted at the temperature of 85° C. with platinum or stainless-steel anodes. $D_k=0.2$ A/dm$^2$, pH=8.5, stirring.

The current yield is 100%. Vickers hardness of the coating is 100 kg/mm$^2$. The coating is dense, glossy, yellow.

EXAMPLE 8

To 1 liter of the electrolyte produced in Example 1 there are added 15 g of ethylenediaminetetraacetatocadmiumbis-(2-aminoethylammonium). As a result, a gold-plating electrolyte is obtained which has the following composition, g/l:

| | |
|---|---|
| hexapotassium-m-ethylenediaminetetraacetatobis-(auruous sulphite) | 210 |
| sodium and potassium salts of ethylenediaminetetraacetic acid | 52 |
| ethylenediaminetetraacetatocadmium-bis-(2-aminoethylammonium) | 15 |
| distilled water | the balance. |

The electrodeposition is conducted at the temperature of 40° C. with platinum, platinized-titanium or stainless-steel anodes. $D_k=0.8$ A/dm$^2$, pH=8.0, stirring.

The current yield is 100%. Vickers hardness of the coating is 200 kg/mm$^2$. The coating is glossy, yellow.

EXAMPLE 9

To 1 liter of the electrolyte produced in Example 3 there is added 1 g of ethylenediaminetetraacetatocadmium-bis-(2-aminoethylammonium). As a result, a gold-plating electrolyte is obtained with the following composition, g/l:

| | |
|---|---|
| hexapotassium-m-ethylenediaminetetraacetatobis-(auruous sulphite) | 27 |
| sodium and potassium salts of ethylenediaminetetraacetic acid | 19 |

-continued

| | |
|---|---|
| ethylenediaminetetraacetatocadmium-bis-(2-aminoethylammonium) | 1 |
| distilled water | the balance. |

The electrodeposition is conducted at the temperature of 60° C. with platinum, platinized-titanium or stainless-steel anodes. $D_k=0.4$ A/dm$^2$, pH=9.0, stirring.

The current yield is 100%. Vickers hardness of the coating is 140 kg/mm$^2$. The coating is dense, glossy, yellow.

EXAMPLE 10

To 1 liter of the electrolyte produced in Example 3 there are added 1.5 g of ethylenediaminetetraacetatocopper/II/-bis-(2-aminoethylammonium). As a result, a gold-plating electrolyte is obtained which has the following composition, g/l:

| | |
|---|---|
| hexapotassium-m-ethylenediaminetetra-acetatobis-(aurous sulphite) | 27 |
| sodium and potassium salts of ethylene-diaminetetraacetic acid | 19 |
| ethylenediaminetetraacetatocopper/II/-bis-(2-aminoethylammonium) | 1.5 |
| distilled water | the balance. |

The electrodeposition is conducted at the temperature of 60° C. with platinum, platinized-titanium or stainless-steel anodes. $D_k=0.4$ A/dm$^2$, pH=8.5, stirring.

The current yield is 100%. Vickers hardness of the coating is 150 kg/mm$^2$. The coating is glossy, pinkish-yellow.

EXAMPLE 11

To 1 liter of the electrolyte produced in Example 4 there are added 15 g of ethylenediaminetetraacetatocopper/II/-bis-(2-aminoethylammonium). As a result, a gold-plating electrolyte is obtained which has the following composition, g/l:

| | |
|---|---|
| hexapotassium-m-ethylendiaminetetra-acetatobis-(aurous sulphite) | 105 |
| sodium and potassium salts of ethylenedia-minetetraacetic acid | 140 |
| ethylenediaminetetraacetatocooper/II/-bis-(2-aminoethylammonium) | 15 |
| distilled water | the balance. |

The electrodeposition is conducted at the temperature of 40° C. with platinum, platinized-titanium or stainless-steel anodes. $D_k=0.8$ A/dm$^2$, pH=9.0, stirring.

The current yield is 100%. Vickers hardness of the coating is 180 kg/mm$^2$. The coating is glossy, yellow.

EXAMPLE 12

To 1 liter of the electrolyte prepared in Example 2 there is added 0.01 g of ethylenediaminetetraacetatocopper/II/-bis(2-aminoethylammonium). As a result, a gold-plating electrolyte is obtained which has the following composition, g/l:

| | |
|---|---|
| hexapotassium-m-ethylenediaminetetraace-tatobis-(aurous sulphite) | 10.5 |
| sodium and potassium salts of ethylene-diaminetetraacetic acid | 17.8 |
| ethylenediaminetetraacetatocopper/II/-bis-(2-aminoethylammonium) | 0.01 |
| distilled water | the balance. |

The electroplating is conducted at the temperature of 80° C. with anodes of platinum, platinized titanium or stainless steel. $D_k=0.2$ A/dm$^2$, pH=9.0, stirring.

The current yield is 100%. Vickers hardness is 100 kg/mm$^2$. The coating is glossy, yellow.

What is claimed is:

1. A gold-plating electrolyte free of alkali metal phosphates and sulfates with a current yield of between 97 and 100% comprising in g/l:

| | |
|---|---|
| hexapotassium-m-ethylenediaminetetra-acetatobis-(aurous sulphite) | 10.5–210 |
| alkali metal salts of ethylenediamine-tetraacetic acid | 17.8–140 |
| distilled water | in an amount to make 1 liter of solution. |

2. A gold plating electrolyte as claimed in claim 1, containing also ethylenediaminetetraacetatocopper-/II/-bis-(2-aminoethylammonium) in an amount of from 0.01 to 15 g/l.

3. A gold-plating electrolyte as claimed in claim 1, containing also ethylenediaminetetraacetatocadmium-bis-(2-aminoethylammonium) in an amount of from 0.01 to 15 g/l.

4. A process for producing a gold-plating electrolyte comprising reacting of the reagents chloroauric acid, an alkali metal salt of ethylenediaminetetracetic acid, an alkali metal sulphite, caustic potash and ammonium chloride in a single stage in distilled water at a temperature of from 80° to 90° C. with the following proportions of the reagents, g/l;

| | |
|---|---|
| chloroauric acid | 12.6–250 |
| alkali metal salt of ethylenediamine-tetraacetic acid | 39–1,000 |
| alkali metal sulphite | 6–190 |
| caustic potash | 32–800 |
| ammonium chloride | 6.6–132; |

whereby a gold-plating electrolyte is obtained along with a precipitate of chlorides and sulphates of alkali metals; and separating precipitate from the electrolyte by filtration.

5. A process as claimed in claim 4, and the further step of adding to the resulting electrolyte after the filtration ethylenediaminetetraacetatocopper/II-bis-(2-aminoethylammonium) in an amount of from 0.01 to 15 g/l.

6. A process as claimed in claim 4, and the further step of adding to the resulting electrolyte after the filtration ethylenediaminetetraacetatocadmium-bis-(2-aminoethylammonium) in an amount of from 0.01 to 15 g/l.

7. A gold-plating electrolyte with a current yield of between 97 and 100% consisting essentially of in g./l.

| | |
|---|---|
| hexapotassium-m-ethylenediaminetetra-acetatobis-(aurous sulphite) | 10.5–210 |
| alkali metal salts of ethylenediamine- | 17.8–140 |

-continued

| | |
|---|---|
| tetraacetic acid | |
| distilled water | in an amount to make 1 liter of solution. |

8. A gold-plating electrolyte with a current yield of between 97 and 100% consisting essentially of in g./l.:

| | |
|---|---|
| hexapotassium-m-ethylenediaminetetra-acetatobis(aurous sulphite) | 10.5–210 |
| alkali metal salts of ethylenediamine-tetraacetic acid | 17.8–140 |
| an agent which increases the current yield and coating hardness selected from ethylenediaminetetraacetatocopper/II/-bis-(2-aminoethylammonium) and ethylenediaminitetraacetato-cadmium-bis-(2-aminoethylammonium) | 0.01 to 15 g./l |
| distilled water | in an amount to make one liter of solution. |

* * * * *